US010508868B2

(12) United States Patent
Liu et al.

(10) Patent No.: US 10,508,868 B2
(45) Date of Patent: Dec. 17, 2019

(54) PROTECTION STRUCTURE FOR HEAT DISSIPATION UNIT

(71) Applicant: ASIA VITAL COMPONENTS CO., LTD., New Taipei (TW)

(72) Inventors: Han-Min Liu, New Taipei (TW); Jian Zhang, New Taipei (TW); Xiao-Xiang Zhou, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 0 days.

(21) Appl. No.: 15/842,849

(22) Filed: Dec. 14, 2017

(65) Prior Publication Data

US 2019/0186839 A1 Jun. 20, 2019

(51) Int. Cl.
*F28D 15/02* (2006.01)

(52) U.S. Cl.
CPC ..... *F28D 15/0283* (2013.01); *F28D 15/02* (2013.01); *F28D 15/0233* (2013.01)

(58) Field of Classification Search
CPC ... F28D 15/02; F28D 15/0233; F28D 15/0283
See application file for complete search history.

(56) References Cited

U.S. PATENT DOCUMENTS 6,276,444 B1 * 8/2001 Li ..... F28D 15/0283 165/104.21
6,907,918 B2 * 6/2005 Connors ..... F28D 15/0283 165/104.21
9,032,624 B2 * 5/2015 Yang ..... F28D 15/0233 29/890.032
2003/0066628 A1 * 4/2003 Mochizuki ..... F28D 15/0233 165/104.26
2006/0000588 A1 * 1/2006 Kang ..... F24D 3/16 165/170
2011/0155350 A1 * 6/2011 Huang ..... F28D 15/0233 165/104.26
2017/0059254 A1 * 3/2017 Zhang ..... F28D 15/0233

FOREIGN PATENT DOCUMENTS

| | | |
|---|---|---|
| CN | 201653234 U | 11/2010 |
| CN | 204678941 U | 9/2015 |
| CN | 106225538 A | 12/2016 |
| TW | M355546 | 4/2009 |

* cited by examiner

*Primary Examiner* — Eric S Ruppert
(74) *Attorney, Agent, or Firm* — Thomas J. Nikolai; DeWitt LLP

(57) ABSTRACT

A protection element for heat dissipation unit includes a main body and a protection element. The main body is divided into a working zone and a sealing zone. The sealing zone is located around an outer periphery of the working zone and is provided with a notch area, to which a fluid-adding and air-evacuating pipe is connected. The protection element is a ductile structure correspondingly arranged at the notch area to contact with the sealing zone of the main body and the pipe. With the arrangement of the protection element, the fluid-adding and air-evacuating pipe is protected against collision and impact and accordingly, the main body of the heat dissipation unit is protected against vacuum and working fluid leakage.

5 Claims, 7 Drawing Sheets

PROTECTION STRUCTURE FOR HEAT DISSIPATION UNIT

FIELD OF THE INVENTION

The present invention relates to a protection structure for heat dissipation unit, and more particularly, to a protection structure for protecting a fluid-adding and air-evacuating pipe structure provided on a heat dissipation unit, such as a vapor chamber.

BACKGROUND OF THE INVENTION

A vapor chamber is a very popular heat dissipation element. Conventionally, the vapor chamber is formed of an upper plate member and a lower plate member, which are closed to each other to define a sealed chamber in between them. In the sealed chamber, a wick structure and a working fluid are provided and air is evacuated to complete the manufacturing of the vapor chamber.

Please refer to FIGS. 1*a*, 1*b* and 2, which show some conventional vapor chambers 5. As shown, to facilitate the adding of the working fluid into the sealed chamber and the evacuating of air from the sealed chamber, a conventional vapor chamber 5 is usually provided with a pipe 6, which is communicable with the sealed chamber of the vapor chamber 5. Finally, an outer end of the pipe 6 is sealed to keep the vapor chamber 5 in a vacuum-tight state. Since the pipe 6 is protruded beyond an outer configuration of the vapor chamber 5, it is subjected to collision, breaking and damage during transporting or assembling the vapor chamber 5 to result in leakage of vacuum and working fluid from the sealed chamber. To overcome this problem, there are provided a first conventional vapor chamber 5 having one of its four corners being chamfered, as shown in FIG. 1*a*, and a second conventional vapor chamber 5 having one of its four edges being formed with a notch area 52, as shown in FIG. 1*b*, and the pipe 6 is provided at the chamfered corner 51 and the notch area 52, respectively, to reduce the possibility of impacting or damaging the protruded pipe 6. However, the chamfered corner 51 and the notch area 52 formed on the vapor chambers 5 do not provided good pipe protection effect.

There is also provided a third conventional vapor chamber 5 having a protection bar 53 transversely extended across the notch area 52, as shown in FIG. 2, so as to protect the pipe 6 against colliding, impacting and damage. For the protection bar 53 to provide effective protection to the pipe 6, the protection bar 53 must be additionally formed on one of the upper and the lower plate member 5*a*, 5*b* of the vapor chamber 5. This will inevitably and disadvantageously increase the processing procedures, the time and accordingly, the cost for manufacturing the vapor chamber 5.

Further, the provision of the protection bar 53 at the notch area 52 would form a hindrance that interferes with the working fluid adding and the air evacuation via the pipe 6, causing inconvenience to workers who handle these operations.

It is therefore tried by the inventor to develop an improved protection structure that protects the fluid-adding and air-evacuating pipe structure provided on a heat dissipation unit and eliminates the disadvantages in the conventional pipe protection structures for vapor chambers.

SUMMARY OF THE INVENTION

A primary object of the present invention is to provide a protection structure that can protect a fluid-adding and air-evacuating pipe structure provided on a heat dissipation unit, so as to solve the problems in the prior art heat dissipation unit.

To achieve the above and other objects, the protection structure for heat dissipation unit according to a preferred embodiment of the present invention includes a main body and a protection element.

The main body is divided into a working zone and a sealing zone. The sealing zone is located around an outer periphery of the working zone and is provided with a notch area, to which a fluid-adding and air-evacuating pipe is connected. The protection element is a ductile structure and is correspondingly arranged at the notch area to contact with the sealing zone of the main body and the fluid-adding and air-evacuating pipe. With the arrangement of the protection element, the fluid-adding and air-evacuating pipe is protected against collision and impact and accordingly, the main body of the heat dissipation unit is protected against vacuum and working fluid leakage.

According to the present invention, the protection element is a ductile structure molded using any one of a thermoplastic, a thermosetting, a light-curing and an epoxy resin material for protecting the fluid-adding and air-evacuating pipe against collision or impact during transporting or installation of the heat dissipation unit, so as to avoid the occurrence of vacuum and working fluid leakage of the main body and to save of a large amount of cost of manufacturing the heat dissipation unit. And, the arrangement of the protection element does not interfere with the use of the pipe to add working fluid and evacuate the air into and from the main body.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
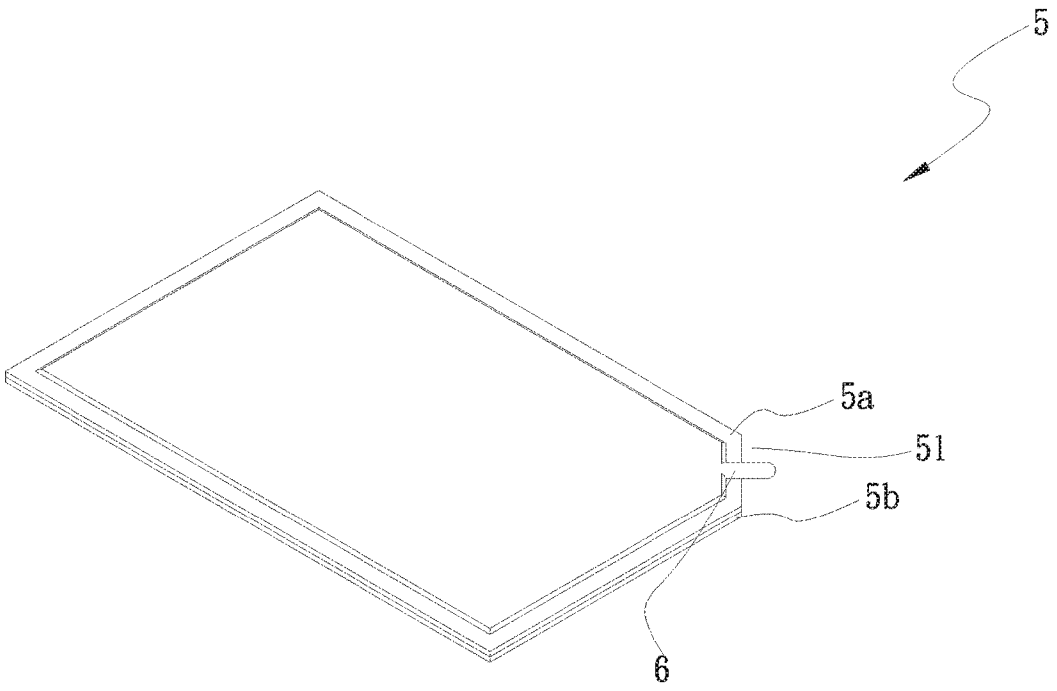
Fig. 1a(Prior art)
FIGS. 1*a* and 1*b* are perspective views of a first and a second conventional vapor chamber, respectively.
Figure 1B:
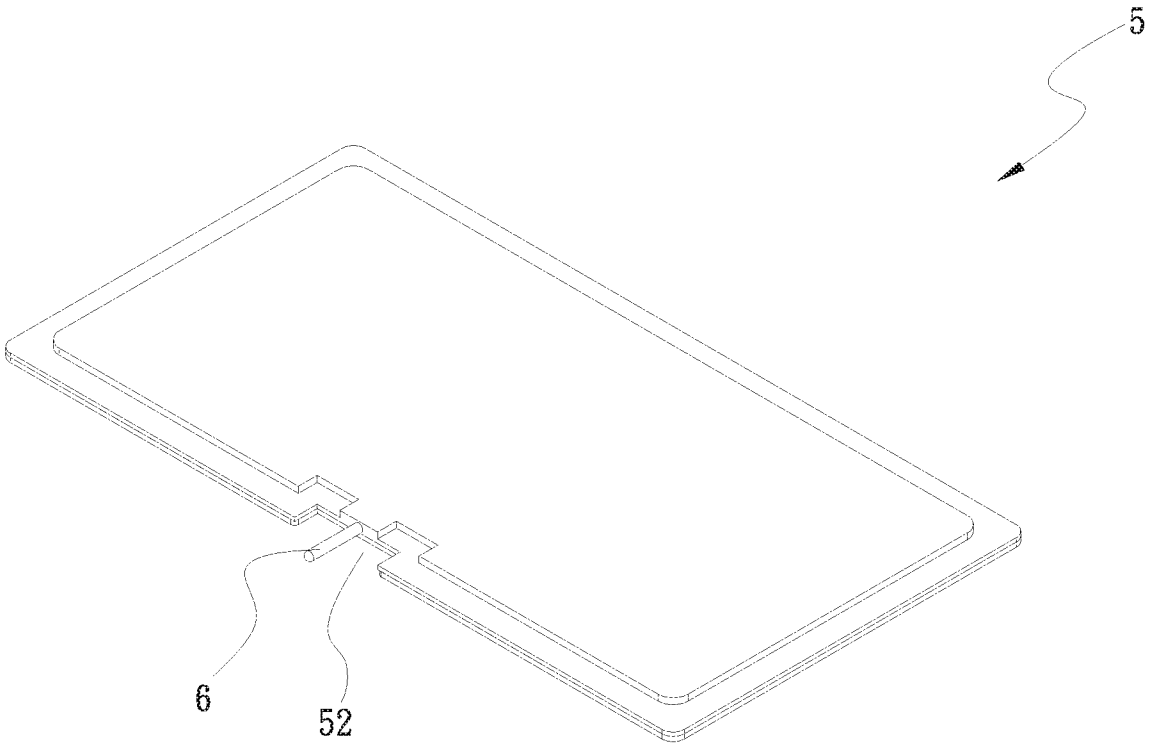
Fig. 1b(Prior art)
Figure 2:
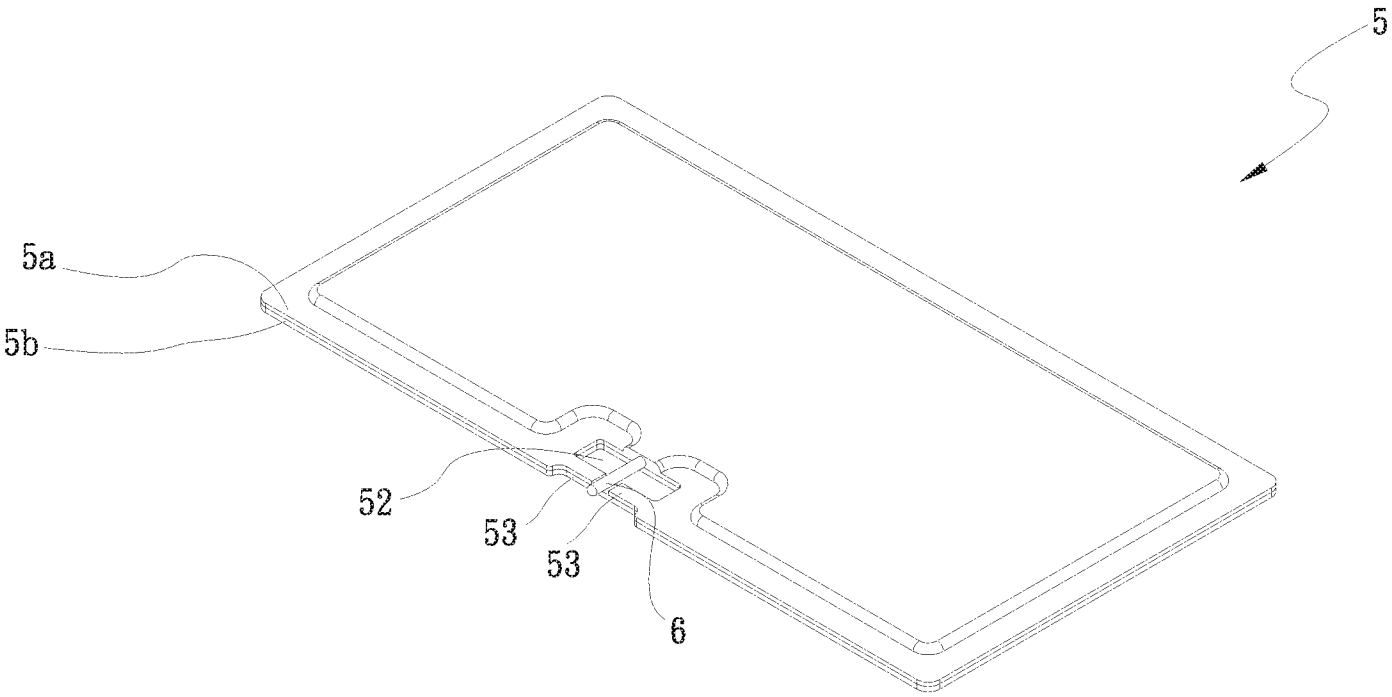
Fig. 2(Prior art)
FIG. 2 is a perspective view of a third conventional vapor chamber.

The present invention will now be described with some preferred embodiments thereof and by referring to the accompanying drawings. For the purpose of easy to understand, elements that are the same in the preferred embodiments are denoted by the same reference numerals.

Figure 3:
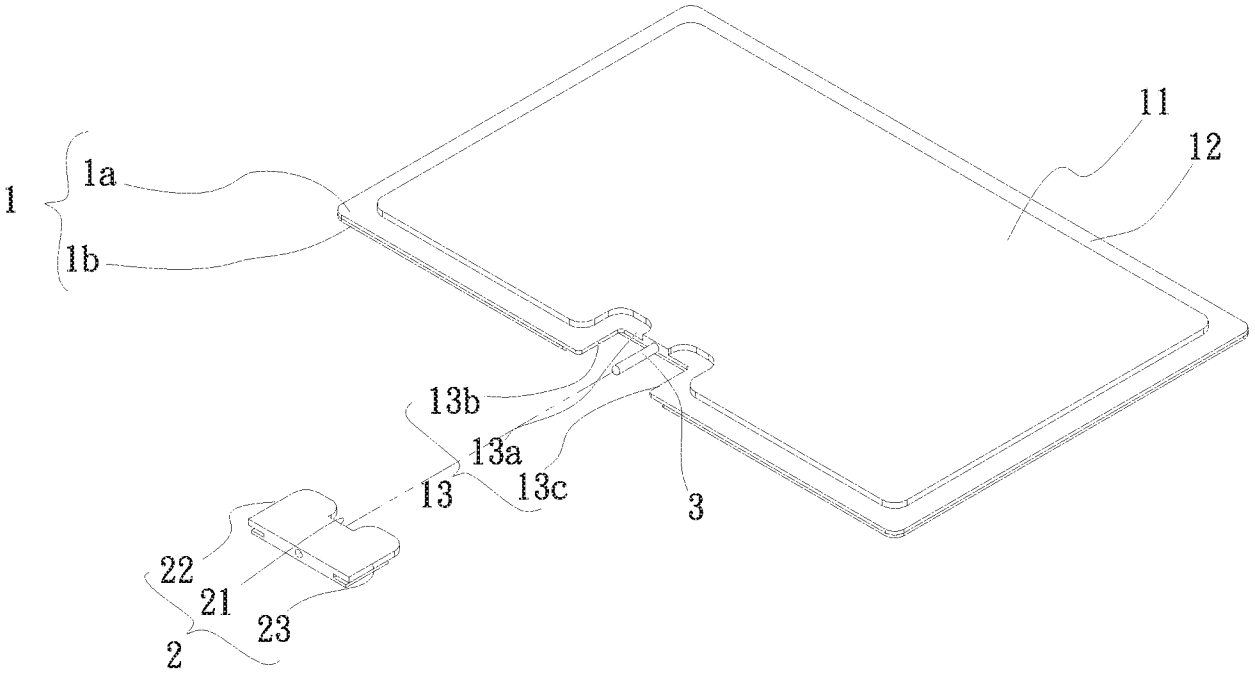
FIG. 3 is an exploded perspective view showing a protection structure for heat dissipation unit according to a first embodiment of the present invention.
Figure 4:
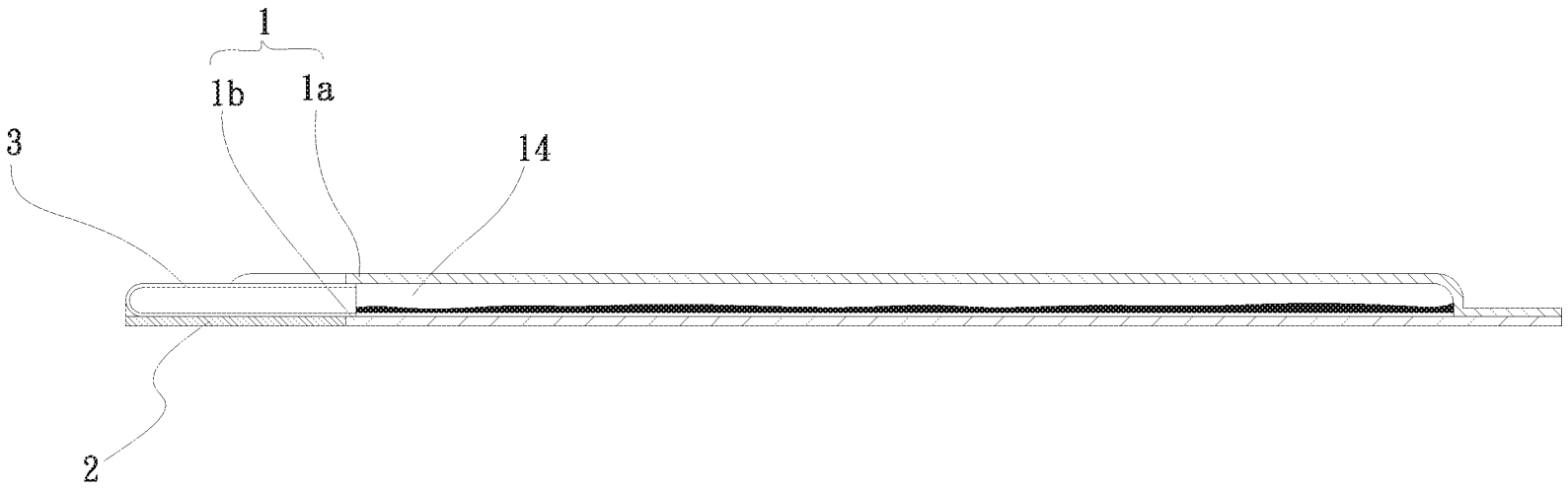
FIG. 4 is an assembled sectional view of the protection structure for heat dissipation unit according to the first embodiment of the present invention.

Please refer to FIGS. 3 and 4, which are exploded perspective view and assembled sectional view, respectively, of a protection structure for heat dissipation unit according to a first embodiment of the present invention. As shown, in the first embodiment, the protection structure for heat dissipation unit includes a main body 1 and a protection element 2.

The main body 1 can be, for example, a vapor chamber, which is divided into a working zone 11 and a sealing zone 12. The sealing zone 12 is located around an outer periphery of the working zone 11 and is provided with a notch area 13, to which a pipe 3 for working fluid adding and air evacuation is connected. The main body 1 is formed by correspondingly closing an upper plate member 1*a* and a lower plate member 1*b* to each other, such that a sealed chamber 14 is defined in between the closed upper and lower plate members 1*a*, 1*b*. In the sealed chamber 14, a wick structure 15, bosses or plated layers and a working fluid 16 are provided. The sealed chamber 14 is formed in the working zone 11, and the sealing zone 12 is located around outer edges of the sealed chamber 14. That is, the sealing zone 12 is an area at where the upper and lower plate members 1*a*, 1*b* are hermetically connected to each other. The pipe 3 is clamped to between the upper and the lower plate member 1*a*, 1*b* to form a part of the main body 1 and communicate with the sealed chamber 14. An outer end of the pipe 3 is a free end, which is sealed after the vapor chamber is completed.

The notch area 13 has a first side 13*a*, a second side 13*b* and a third side 13*c*. The second side 13*b* and the third side 13*c* are located at and connected to two opposite ends of the first side 13*a*; and the pipe 3 is extended through and connected to the first side 13*a*.

The protection element 2 is a ductile structure made of a thermoplastic, a thermosetting, a light-curing or an epoxy resin material and is correspondingly formed and located at the notch area 13 through insert molding to contact with the sealing zone 12 of the main body 1 and the pipe 3. The protection element 2 has a first edge 21, a second edge 22 and a third edge 23, which are so configured that they cover the first, the second and the third side 13*a*, 13*b*, 13*c* of the notch area 13, respectively.

Figure 5:
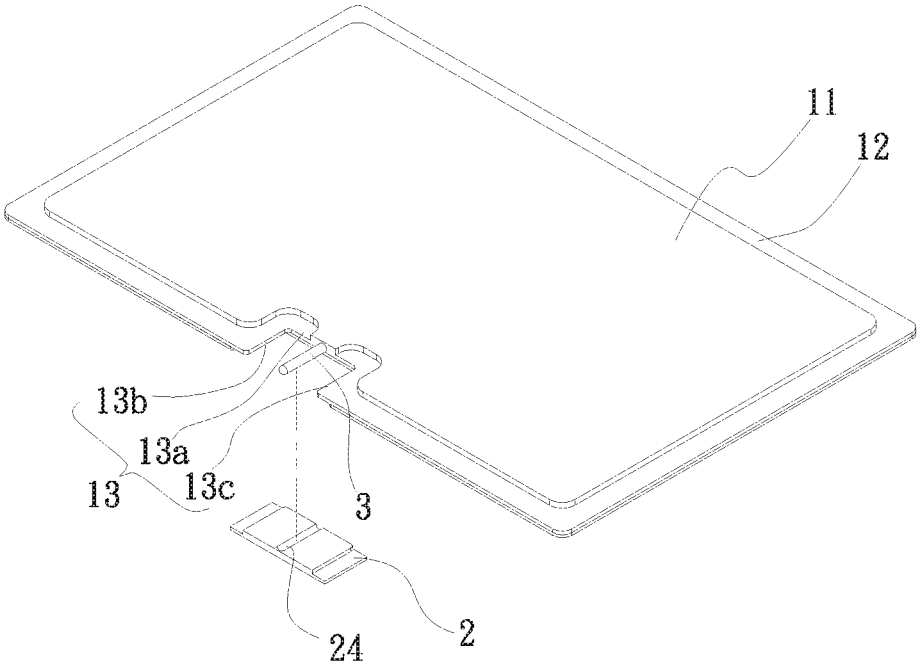
FIG. 5 is an exploded perspective view showing a protection structure for heat dissipation unit according to a second embodiment of the present invention.

Please refer to FIG. 5, which is an exploded perspective view showing a protection structure for heat dissipation unit according to a second embodiment of the present invention. The second embodiment is different from the first embodiment in that the protection element 2 in the second embodiment includes a first recessed section 24, which is configured for contacting with and covering at least one-half of an outer circumferential surface of the pipe 3. Again, the protection element 2 is a ductile structure made of a thermoplastic, a thermosetting, a light-curing or an epoxy resin material. After the protection element 2 is plastically cured, the first, second and third edges 21, 22, 23 thereof can be attached to and engaged with the first, second and third sides 13*a*, 13*b*, 13*c* of the notch area 13, respectively, while the first recessed section 24 axially formed at a middle area of the protection element 2 is in partial contact with the outer circumferential surface of the pipe 3. Since all other structural and functional features of the second embodiment are similar to those of the first embodiment, they are not repeatedly described herein.

Figure 6:
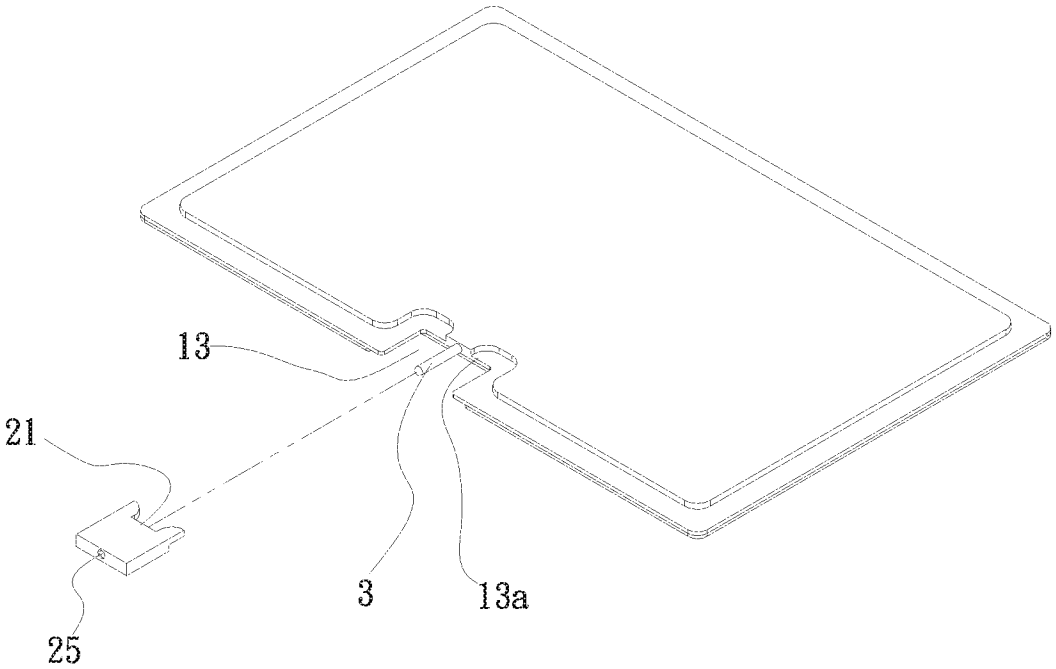
FIG. 6 is an exploded perspective view showing a protection structure for heat dissipation unit according to a third embodiment of the present invention.

Please refer to FIG. 6, which is an exploded perspective view showing a protection structure for heat dissipation unit according to a third embodiment of the present invention. The third embodiment is different from the first embodiment in that the protection element 2 in the third embodiment includes a first receiving shaft hole 25, within which the pipe 3 is fitly received. More specifically, in the third embodiment, the protection element 2 is connected to the pipe 3 through fitting of the pipe 3 in the first receiving shaft hole 25 and connected to the main body 1 through engagement of the first edge 21 of the protection element 2 with the first side 13*a* of the notch area 13. In this manner, the protection element 2 can effectively protect the pipe 3 against breaking or damage. Since all other structural and functional features of the third embodiment are similar to those of the first embodiment, they are not repeatedly described herein.

The light-curing material used in the present invention is obtained by adding a photosensitive agent to a specially formulated resin. When the light-curing material is exposed to a high-intensity violet ray from a light curing apparatus, the light-curing material absorbs the violet ray and produces active free radicals or radical ions to trigger the polymerization, cross-linking and grafting reactions, which bring the resin, which can be a ultraviolet (UV) paint, a UV ink, or a UV glue, to convert from a liquid-state substance into a solid-state polymer within only a few seconds. The above described conversion process is referred to as the light curing process.

In the above embodiments, when the protection element 2 made of a thermoplastic or a thermosetting material is cooled, it is associated with the main body 1 to serve as a protection structure for the notch area 3 and the pipe 3. Alternatively, in the case the protection element 2 is made of a light-curing material, it can be applied to the main body 1 at the notch area 13 and the pipe 3 to form the protection structure for the notch area 13 and the pipe 3. A main advantage of using the protection structure of the present invention is the protection of the pipe 3 against collision or impact during transporting or installation of the heat dissipation unit to avoid the occurrence of vacuum and working fluid leakage of the main body 1. The present invention also advantageously saves of a large amount of cost of manufacturing the heat dissipation unit and it does not interfere with the use of the pipe 3 to add the working fluid and evacuate the air into and from the main body 1 during the manufacturing process of the heat dissipation unit.

Further, compared to the conventional integrally formed protection structures for heat dissipation unit that require a relatively higher manufacturing cost and a plurality of molds and dies, the protection structure of the present invention is immediately formed for use after the material thereof is cooled and shaped, and can therefore be manufactured at a relatively lower cost.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A protection structure for a heat dissipation unit, comprising:

a main body divided into a working zone and a sealing zone; the working zone internally forming a sealed chamber, the sealing zone being located around an outer edge of the sealed chamber and being provided with a notch area, to which a protrusion pipe for working fluid adding and air evacuation is connected, and the sealing zone being an area at which an upper and lower plate member are hermetically connected to each other, the protrusion pipe being clamped between the upper and the lower plate members to communicate with the sealed chamber, wherein the notch area is defined as a notch in one of the upper and lower plate member, an exposed space to expose the protrusion pipe; and a protection element being a ductile structure and correspondingly formed and located at the notch area to seal the exposed space and to at least partially cover the protrusion pipe;

wherein the notch area has a first side, a second side located at and connected to one of two opposite ends of the first side, and a third side located at and connected to the other end of the first side; and wherein the protection element has a first edge, a second edge and a third edge configured for covering the first, the second and the third side of the notch area, respectively.

2. The protection structure for a heat dissipation unit as claimed in claim 1, wherein the protection element includes a first recessed section configured for contacting with and covering at least one-half of an outer circumferential surface of the protrusion pipe.

3. The protection structure for a heat dissipation unit as claimed in claim 1, wherein the protection element includes a first receiving shaft hole, and the pipe being fitly received in the first receiving shaft hole.

4. The protection structure for a heat dissipation unit as claimed in claim 1, wherein the protection element is correspondingly formed and located at the notch area of the main body through insert molding to be in contact with the sealing zone of the main body and the protrusion pipe.

5. The protection structure for a heat dissipation unit as claimed in claim 1, wherein the protection element is a ductile structure molded using any one of a thermoplastic, a thermosetting, a light-curing and an epoxy resin material.

* * * * *